United States Patent [19]

Strudel

[11] Patent Number: 4,794,677

[45] Date of Patent: Jan. 3, 1989

[54] APPARATUS FOR SINGEING TUBULAR TEXTILE FABRIC

[75] Inventor: Werner Strudel, Friedrichshafen, Fed. Rep. of Germany

[73] Assignee: Lindauer Dornier Gesellschaft mbH, Lindau/Bodensee, Fed. Rep. of Germany

[21] Appl. No.: 63,157

[22] Filed: Jun. 15, 1987

[30] Foreign Application Priority Data

Jun. 27, 1986 [DE] Fed. Rep. of Germany ..... 3621643

[51] Int. Cl.[4] ..... D06C 9/02; D06C 5/00

[52] U.S. Cl. ..... 26/3

[58] Field of Search ..... 26/3, 81, 85

[56] References Cited

U.S. PATENT DOCUMENTS

| | | | |
|---|---|---|---|
| 2,274,600 | 2/1942 | Hanes . | |
| 3,028,622 | 4/1962 | Park | 26/3 X |
| 3,678,545 | 7/1972 | Hino et al. | 26/85 |
| 4,337,630 | 7/1982 | Strahm | 26/85 X |
| 4,475,417 | 10/1984 | Dornier | 26/3 |
| 4,608,767 | 9/1986 | Dornier | 26/81 X |

FOREIGN PATENT DOCUMENTS

| | | | |
|---|---|---|---|
| 3047352 | 3/1985 | Fed. Rep. of Germany . | |
| 5039186 | 12/1975 | Japan | 26/3 |
| 1161613 | 6/1985 | U.S.S.R. | 26/81 |

*Primary Examiner*—Robert R. Mackey

*Attorney, Agent, or Firm*—W. G. Fasse; D. H. Kane, Jr.

[57] ABSTRACT

Tubular textile fabric passes through a singeing apparatus preferably vertically upwardly. A guide path including a circular spreader guides the tubular fabric past gas operated singeing nozzles which are position adjustable in parallel to the longitudinal travel direction and radially thereto. The circular spreader forms a conical zone in the tubular fabric and the singeing nozzles are located around the conical zone so that an axial position adjustment of the nozzles changes the spacing between the nozzles and the fabric and a radial adjustment of the nozzles centers the nozzles relative to the fabric. The conical zone may taper in a direction opposite to the travel direction or in the travel direction of the fabric. The taper and its direction is determined by the diameter and the location of fabric guide rings forming part of the spreader. Cooling devices are located downstream of the singeing nozzles as viewed in the travel direction of the fabric.

21 Claims, 7 Drawing Sheets

APPARATUS FOR SINGEING TUBULAR TEXTILE FABRIC

FIELD OF THE INVENTION

The invention relates to an apparatus for singeing tubular textile fabric. Such an apparatus includes a circular spreader for the fabric. The spreader is substantially rigid and surrounded by a singeing device.

DESCRIPTION OF THE PRIOR ART

U.S. Pat. No. 2,274,600 (Hanes) describes a tubular knit fabric singeing apparatus with a rigidly mounted singeing device. The tubular knit fabric travels over a rigid spreader, the diameter of which is constant and cannot be varied. The conventional spreader has essentially the shape of a cylindrical cage. The singeing nozzles are installed in a rigid ring encircling the tubular fabric, or rather, the circular spreader. This ring carrying the nozzles is eccentrically movable or displaceable only to a limited extent in order to center the singeing device relative to the fabric and in order to provide a uniform spacing all around the fabric between the fabric and the flames. The known apparatus cannot be adapted to different diameters of the tubular fabric. A cylindrical protection shield can be inserted between the singeing nozzles and the tubular fabric. This protection shield extends in parallel to the travel direction of the fabric in order to keep the flames away from the fabric if desired.

In the apparatus of U.S. Pat. No. 2,274,600 (Hanes), it is also not possible to vary or adjust the spacing of the burner nozzles from the fabric when the fabric has a uniform diameter. However, such adjustment is desirable, for example, when different types of fabrics are involved.

German Patent Publication (DE-OS) No. 3,047,352 discloses another gas operated singeing device, wherein fabric stretchers are used which can be widened in a cylindrical manner so to speak, whereby these spreaders are adaptable to tubular fabrics of differet diameters. A ring-shaped mounting member surrounding the spreader forms a carrier for a plurality of singeing heads which are radially and synchronously adjustable relative to the spreader. These singeing heads carry their respective gas burning nozzles. When the spreader is in its widened state, the singeing heads are located close to each other in the circumferential direction, whereby all the singeing heads together form, with their fabric facing sides, a boundary which is adapted to the cross-section of the spreader. When the diameter of the spreader is reduced, the individual singeing heads are radially displaced in synchronism with each other for adaption of the burner spacing from the fabric in accordance with the reduced spreader diameter. In order to accomplish this adaptation, a rotational motion is superimposed on the radial motion of the singeing heads in such a manner that neighboring singeing heads are always closely spaced from each other in a projection onto a cross-sectional plane of the spread.

The structure according to German Patent Publication No. 3,047,352 permits an adjustment of the burner spacings for different tubular fabric diameters. However, such a structure is subject to a structural effort and expense which in most instances is too large.

OBJECTS OF THE INVENTION

In view of the foregoing, it is the aim of the invention to achieve the following objects singly or in combination:

to construct a singeing apparatus in such a way that the spacing of the burner nozzles from the tubular fabric is precisely adjustable by simple means even if the diameter of the tubular fabric remains the same;

to efficiently cool the singed tubular fabric;

to properly guide and spread the tubular fabric for presenting the fabric to the singeing nozzles and to the cooling means; and to provide means for increasing the spreader diameter.

SUMMARY OF THE INVENTION

The apparatus according to the invention is characterized by the following features. The fabric circular spreader comprises a plurality of fabric guide rings which are spaced from each other in the travel direction of the fabric and which divide the circular spreader into at least two zones or sections. Further, the guide rings defining the first spreader zone have different diameters so that a slightly conical guiding is provided for the tubular fabric. The singeing device is mounted in this conical guiding section for a three-dimensional adjustment longitudinally relative to the travel direction of the fabric and radially thereto. A cooling device is arranged in at least one further section or zone of the circular spreader. The cooling device encircles the spreader for applying a cooling medium to the tubular fabric. The adjustment or displacement of the singeing device relative to the spread tubular fabric takes place in a continuous, stepless manner. With this type of adjustment, it is possible to vary the spacing between the singeing nozzles and the conical jacket which is formed by the tubular fabric in the first zone of the spreader providing said conical guiding. Such an adjustment is uniform around the entire circumference of the spread fabric and the adjustment does not require any complicated mechanisms.

The conical guiding of the tubular fabric may be achieved in different ways. For example, the first ring of the spreader may have a smaller diameter than the second or following rings, whereby the conical guide section tapers in a direction opposite to the travel direction of the fabric. In other words, the tubular fabric widens as it travels onto the first conical guide section of the circular spreader. The singeing device is arranged in this first conical section, or rather around this conical section of the spreader, whereby the singeing device encircles the conically guided tubular fabric and whereby the singeing device is displaceable in such a way that the ring carrying the singeing nozzles can be centered relative to the central longitudinal axis of the come and additionally may be displaced in parallel to the longitudinal axis of the conical guiding section.

Another arrangement for forming a conical guiding section for the tubular fabric comprises a ring type cooling system located between the lead-in ring of the circular spreader and the following guide ring. The inner diameter of the ring type cooling system is smaller than the outer diameter of the lead-in ring of the circular spreader. As a result, the cooling system presses the tubular fabric back into a smaller diameter, whereby the tubular fabric assumes a conical shape tapering in the travel direction of the fabric so that the diameter of the conical fabric decreases in the travel direction. The singeing device is located in an adjustable manner in this conical section. The adjustment may be performed again in a radial direction for centering the singeing device and in the axial direction for changing the spacing between the conical surface of the tubular fabric and the singeing device. This type of arrangement is advantageous because the cooling system or device can be located immediately next to the flames of the singeing burner. Another advantage is seen in that in this arrangement any flame guide shield may be arranged so that it is fully and efficiently effective in deflecting the flames in a direction opposite to the travel direction of the tubular fabric. By deflecting the flames when the shield is in an effective deflecting position, it is possible to direct the flames substantially perpendicularly toward the surface of the fabric.

In both of the above described embodiments, it is possible to precisely adjust the spacing between the singeing device or the flame on the one hand, and the surface of the tubular fabric simply by axially displacing the singeing device with the aid of adjustment screws. The spacing changes automatically due to the conical configuration of the fabric in the singeing zone. The adjustment screws secure a carrier frame to which the singeing nozzles are attached, to the machine frame.

The singeing device comprises advantageously a number of singeing rings arranged coaxially to the spreader and stacked one above the other. The singeing nozzles are secured to the singeing rings in such a way that the nozzles face toward the tubular fabric for directing the singeing flame substantially perpendicularly toward the surface of the fabric. Several such nozzle carrying rings may be combined to form a singeing unit in which the nozzles of the individual singeing rings are so oriented or aligned that the flames are focussed on or in a common singeing flame for all singeing rings. Control means such as valves for shutting-off the singeing gas supply may be provided for individually activating or deactivating any one of the plurality of singeing rings. For achieving a uniform singeing of the tubular fabric, the singeing unit or deivce is so arranged on its carrier frame that it may be centered in a radial plane of the spreader. This centering of the singeing unit relative to the longitudinal central axis of the spreader, can be performed independently of the above mentioned axial adjustment of the singeing unit relative to the travel driection of the fabric. Thus, it is possible to precisely adjust the gap width between the singeing unit and the surface of the fabric. As a result, the singeing effect can also be precisely controlled for uniformity over the entire fabric surface.

A circular spreader for the tubular fabric particularly suitable for the present purposes comprises a central carrier which may be shortened or lenghtened in a telescoping manner against the force of a spring. Fabric guide rings are rigidly secured to the central carrier at given axial spacings. Fabric support rollers having a contoured profile, for example a convex surface contour, are secured in pairs to the ends of the central carrier. These fabric support rollers bear with their contoured surface against the inner surface of the tubualr fabric and cooperate with complementing fabric guide rollers secured to the machine frame in positions for cooperation with the inner support rollers. The outer guide rollers contact the outer surface of the fabric with their contoured surfaces. For example, if the inner support rollers have a convex profile, the outer guide rollers have a concave contoured surface or vice versa. Due to the spring biassed telescoping of the central carrier, the circular spreader is spring supported between its inner support rollers and the outer guide rollers.

If desired, the central carrier may be equipped with radial cross arms located approximately at the level of the support rollers. These cross arms extend in parallel to the rotational axis of the neighboring support rollers and the cross arms are adjustable in their length. The cross arms carry guide rollers at their ends and these inner guide rollers cooperate with respective outer counter rollers which are spring supported in the machine frame for clamping the tubular fabric between the inner guide rollers and the outer counter rollers.

At least some of the outer guide rollers located at the beginning and at the end of the spreader in the machine frame outside of the tubular fabric are positively driven to help in transporting the tubular fabric through the apparatus.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
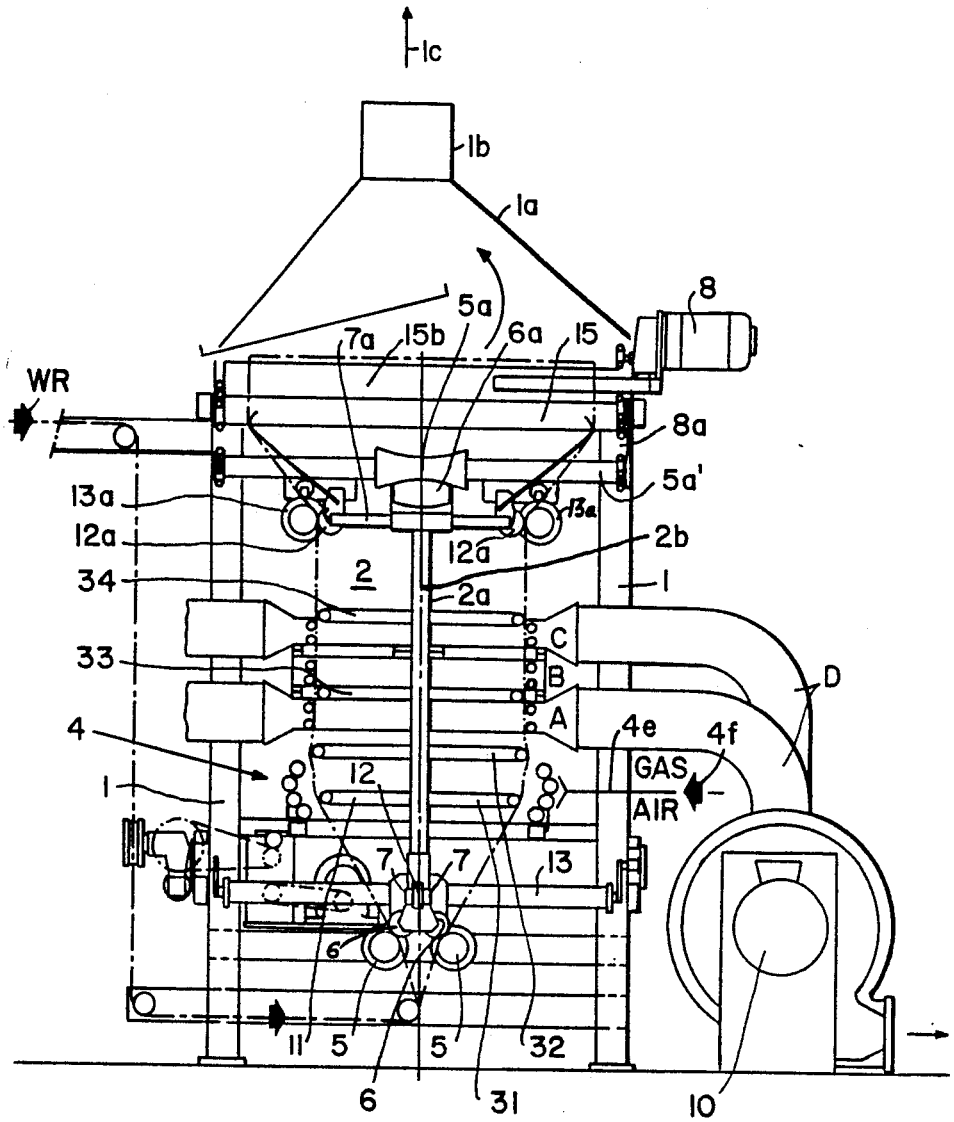
FIG. 1 is a schematic side view of a singeing apparatus according to the invention.

FIG. 1 shows the entire singeing apparatus according to the invention in a schematic manner to provide an overview. A machine frame 1 extends vertically and is supported on a foundation. A circular spreader 2 having a central carrier 2*a* with a longitudinal axis 2*b* extending vertically is operatively supported in the machine frame 1. The circular spreader 2 comprises fabric spreading rings 31, 32, 33 and 34. Each of these rings is rigidly secured by spokes to the central carrier 2*a*. The spreader 2 is supported at its lower end by two carrier rollers or drums 5 mounted in the machine frame 1 and cooperating with spreader support rollers 6. Respective carrier rollers 5*a* and support rollers 6*a* are also arranged at the upper end of the spreader. The details of the mounting of the rollers or drums 5 and 6 as well as 5*a* and 6*a* will be described in more detail below.

The tubular fabric to be treated enters initially into the apparatus along a path defined by arrows WR. The fabric is initially flat and travels over guide rollers as is conventional. The fabric is spread out or widened as it enters onto the circular spreader 2 on which it assumes an approximately cylindrical shape after passing through the widening zone or inlet zone. After leaving the spreader formed by the guide rings 31 to 34, the tubular fabric is again flattened and removed from the apparatus for further treatment. Along the path defined by the above mentioned rollers 5, 6 and 5*a*, 6*a* the fabric is firmly held or even clamped between these rollers at the lower end and at the upper end of the spreader 2.

Figure 2:
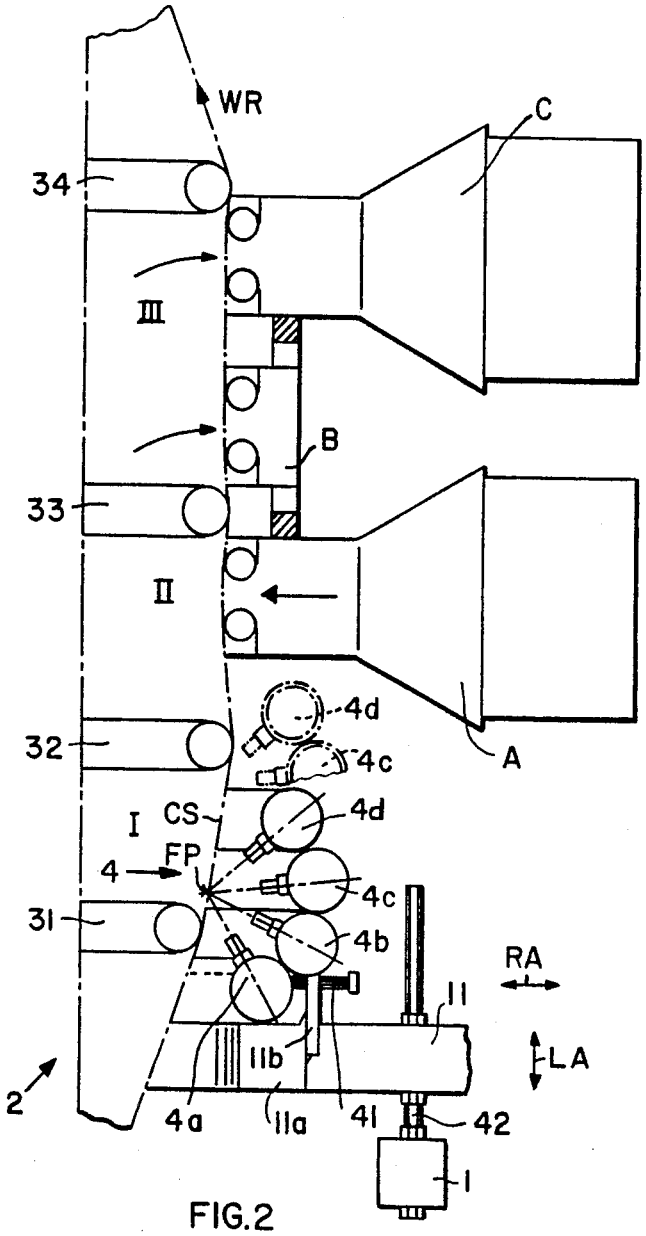
FIG. 2 illustrates, on a somewhat enlarged scale, a righthand portion of FIG. 1 to more clearly illustrate the position adjusting means for the singeing unit and the location of the cooling system.
Figure 3:
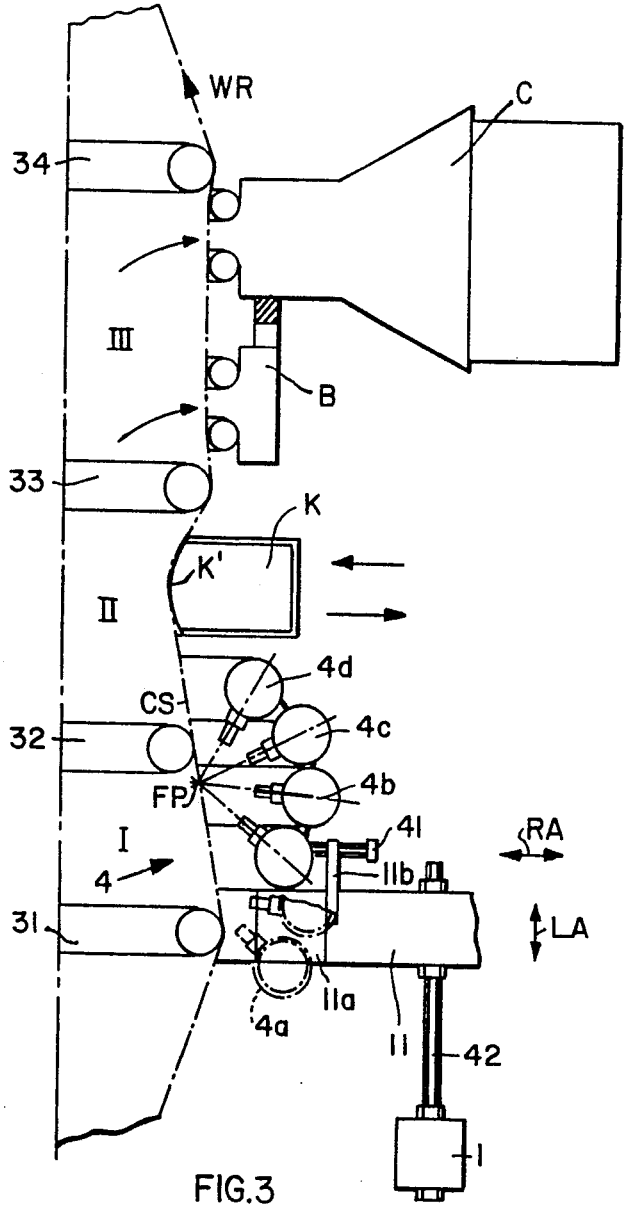
FIG. 3 is a view similar to that of FIG. 2, but showing a modification in the guiding of the fabric over the spreader.

According to the invention, the individual guide rings 31 to 34 divide the spreader into several zones I, II, III as shown in FIGS. 2 and 3. Referring again to FIG. 1, a singeing device or unit 4 is located in the first zone between the guide rings 31 and 32. The singeing device 4 will be described in more detail below. A cooling device or system A is located in the second zone II defined between the rings 32 and 33. Cooling device A removes the hot combustion gases used for the singeing. Further cooling devices B and C are arranged further upwardly as viewed in the travel direction defined by the central axis 2*b* of the spreader 2. The cooling devices B and C are located in the third zone defined between the guide rings 33 and 34. These cooling devices encircle the spreader and are operatively connected through respective ducts D to a fan 10. The fan 10 may be a blower or a suction fan for blowing cooling air onto the fabric or for withdrawing hot combustion gases from the fabric. Several fans may be used for blowing and/or suction cooling.

A cross arm 7 of adjustable length is secured to the lower end of the central carrier 2*a* of the spreader 2. Each end of the cross arm 7 carriers a guide roller 12. Similarly, the upper end of the carrier 2*a* has attached thereto a cross arm 7*a* of adjustable length and carries at each end a respective guide roller 12*a*. The pair of guide rollers 12 at the lower end of the spreader and the pair of guide rollers 12*a* at the upper end of the spreader cooperate with respective counter rollers, or rather pairs of counter rollers 13 and 13*a*. Please see in this connection also FIGS. 6, 7, 8, and 9. When the tubular fabric is transported through the spreader path, the guide rollers 12, 12*a* and the respective counter rollers 13, 13*a* positvely hold or pinch the fabric to lead it onto the spreader and off the spreader. Incidentally, the lower counter rollers 13 are operatively mounted to a cross bar 1' of the machine frame 1. Similarly, the upper counter rollers 13*a* are mounted to a cross bar 1'' of the machine frame 1.

In order to properly flatten the singed fabric when it moves off the upper end of the spreader, there are provided flattening arms 9. These arms 9 are so located that the fabric is pulled by the positively driven upper guide rollers 5*a*, onto a plurality of advance rollers, or rather pull-out rollers 15 shown in FIG. 7. The rollers 5 are conventionally driven by a motor 8 for transporting the fabric as will be explained in more detail below. The singeing apparatus has a hood 1*a* with a stack 1*b* for the escape of any singeing gas 1*c* that has not been withdrawn by any of the cooling devices or systems A, B, and C. Combustion gas and air for the singeing device 4 are supplied through ducts 4*e* as indicated by the arrow 4*f*.

FIG. 2 illustrates the arrangement of the heating device 4 and of the guide rings 31 to 34 in more detail. As mentioned, the fabric guide rings 31, 32, 33, and 34 of the spreader 2 form the several zones I, II, III, whereby the rings 32, 33, and 34 may have the same diameter. However, as shown, the ring 32 has a slightly larger outer diameter than the rings 33 and 34. The lowermost inlet guide ring 31 has the smallest outer diameter in this embodiment. Thus, the fabric forms a conical shape CS in the zone I and this shape CS tapers opposite to the travel direction.

Different types of singeing devices 4 may be employed. The example embodiment shown comprises four burner rings or singeing rings 4*a*, 4*b*, 4*cc*, and 4*d* stacked one above the other and each carrying its plurality of singeing nozzles directed toward the fabric. These nozzles are so oriented, that the tips of the flames produced by these nozzles are focussed onto a common flame plane passing through the point FP in FIG. 2 on the surface of the fabric WR. The nozzles may also have different forms, for example, rows of closely spaced individual nozzles may be provided in the rings 4*a*, 4*d*, or slot nozzles may be employed. The nozzle carrying rings 4*a*, 4*b*, 4*c*, and 4*d* are supported as a unit in a slideable manner on a ring 11*a* which in turn is secured to a carrier frame member 11. A plurality of adjustment screws 41 passing through a bracket 11*b* secured to the support 11*a* permit the adjustment of the unit 4 in a horizontal plane as indicated by the radial adjustment arrow RA. By individually adjusting all the screws 41 the unit 4 can be precisely centered relative to the longitudinal axis 2*b* of the spreader 2. The support member 11 is connected to the machine frame 1 by further adjustment screws 42 which permit a vertical or longitudinal adjustment of the entire unit 4 as indicated by the arrow LA. This vertical or longitudinal adjustment LA permits precisely spacing the nozzles relative to the fabric due to the conical shape CS of the fabric in the singeing zone.

When the singeing is completed, the signed tubular fabric passes into the zone Ii for cooling by the cooling device A which blows cold air onto the fabric. Two further cooling units B and C suck combusted gases through the fabric out of the apparatus. If desired, the cooling device A may also be a suction device. The cooling devices A, B, and C have cooling rings surrounding the fabric in contact therewith for holding the fabric in place. Thus, the fabric cannot bulge, neither inwardly or outwardly.

The number of four singeing rings with their nozzles is not intended to be limiting. Any number of nozzle rings may be used and valves may be provided for switching any one of the nozzle rings on or off. Similarly, the cooling devices may also be used individually and/or in combination. Frequently, a single cooling device A directly downstream of the singeing unit 4 may be sufficient. The construction of the cooling devices is also not critical. For example, the suction rings may be semicircular rings which complement each other around the fabric. Two neighboring cooling suction devices may also be circumferentially spaced or staggered around the spreader.

The embodiment of FIG. 3 is a modification of the embodiment of FIG. 2. In FIG. 2, the conical shape Cs tapers in a direction opposite to the travel direction of the fabric because the first ring 31 has a smaller outer diameter than the second ring 32. In FIG. 3, the conical shape CS tapers in the travel direction of the fabric because the ring 32 has a smaller diameter than the ring 31. Further, the ring 33 has a slightly larger outer diameter than the ring 32 for guiding the fabric against the face K' of a liquid cooled cooling device K. The cooling face K' of the cooling device K has an inner diameter slightly smaller than the outer diameter of the ring 32 for assuring the conical shape CS of the fabric. The mounting and adjusting of the singeing unit 4 in FIG. 3 is the same as that in FIG. 2. The fabric facing inner cooling surface K' of the cooling device K is curved for gently guiding the fabric and for providing a good cooling contact over a substantial length with the fabric to be cooled.

Figure 5:
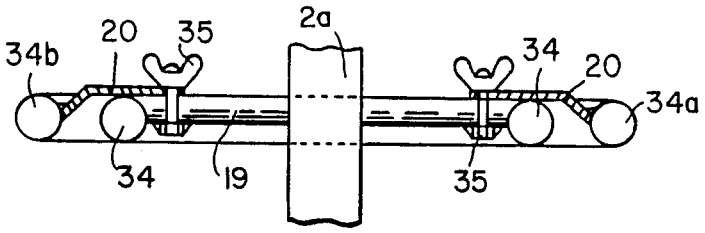
FIG. 5 is a sectional view along section line V—V in FIG. 4.
Figure 4:
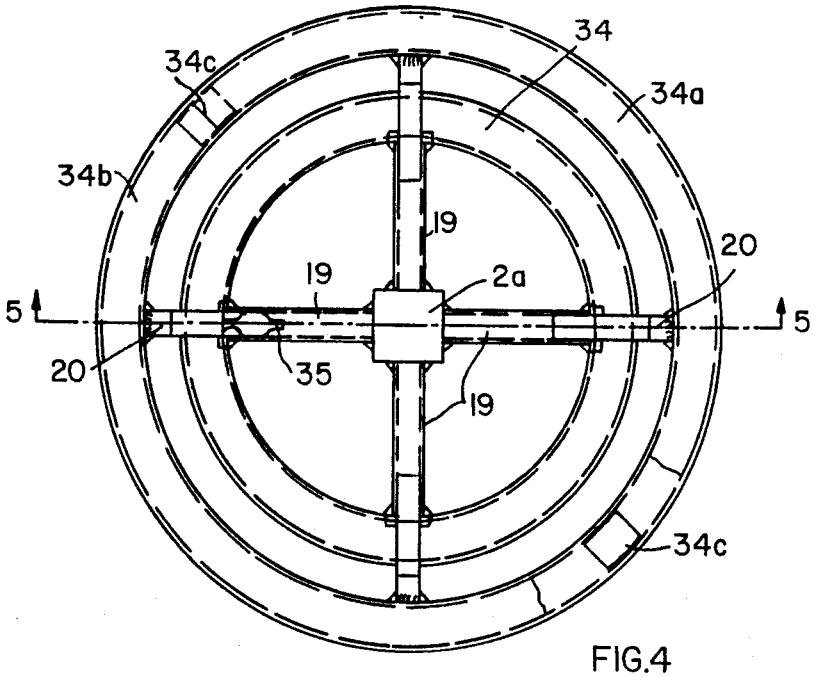
FIG. 4 illustrates a top plan view of a set of rings for the circular spreader.

FIGS. 4 and 5 show the construction of a guide ring for the spreader 2. The ring 34 can be increase in its effective diameter by a second ring having two sections or semicircular rings 34*a* and 34*b* to accommodate fabrics of two different diameters. The inner ring 34 is mounted on four radial arms 19 connected to the central carrier 2*a*. The two semicircular rings 34*a* and 34*b* are interconnected by couplings 34*c* and secured to the inner rings by brackets 20 connected to the respective radial arms 19 by screws and nuts 35, for example wing nuts. Thus, the brackets 20 with their ring sections 34*a* and 34*b* are easily attached or removed from the inner ring 34. The just described features make it possible to construct the entire spreader of rings with the same diameter and to employ the extending rings 36*a* and 34*b* only in those locations where larger diameters are required as described above for obtaining the desired conical shape CS of the fabric in the singeing zone.

Figure 6:
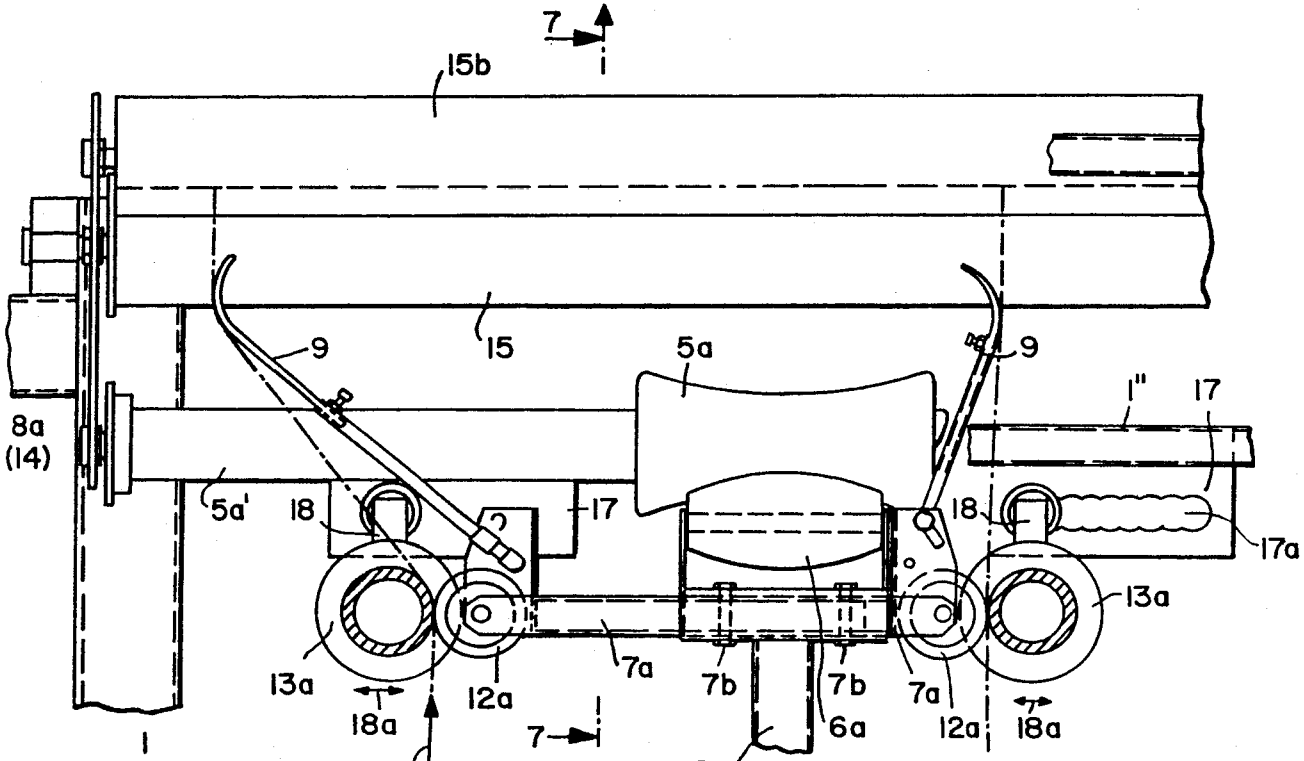
FIG. 6 illustrates the fabric discharge end or the upper end of the circular fabric spreader.
Figure 7:
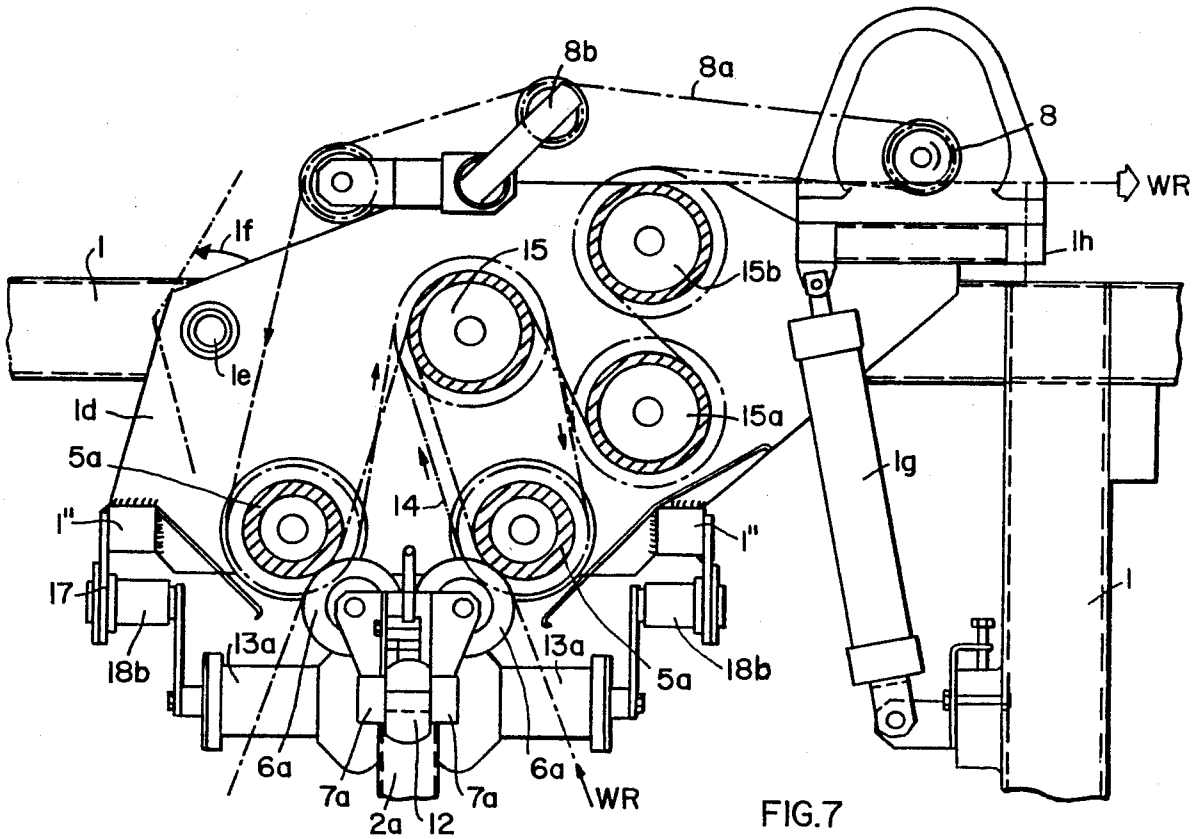
FIG. 7 is a sectional view along section line VII—VII in FIG. 6.

Referring to FIGS. 6 and 7, the upper or outlet end of the circular spreader 2 comprises the above mentioned rollers 5*a* bearing against the outer surface of the fabric and 6*a* bearing against the inner surface of the fabric. The rollers 5*a* are positively driven by drive shafts 5*a*'. As mentioned above, the surfaces of the rollers 5*a* and 6*a* have curved contours which complement each other. The length of the cross arms 7, 7*a* is adjustable, for example, by providing the arm with two sections, one of which is slidable relative to the other section into a plurality of different adjusted positions. Screws 7*b* then interconnect the two sections rigidly to each other in an adjusted position. The two sections may also be connected in an adjustable manner to a mounting bracket of the central carrier 2*a*. The left-hand side of FIG. 6 shows the respective section of the arm 7*a* fully extended, while the right-hand side of FIG. 6 shows the respective section of the arm 7*a* in a fully pulled-position. While the rollers 12*a* are held in rigid positions once the sections of the cross arms 7*a* are adjusted and secured by the screws 7*b*, the outer counter rollers 13*a* are mounted to an adjustment bracket 17 by means of spring members 18 capable of yielding as indicated by the arrows 18*a*. The ends of the spring members 18 may be connected in a plurality of positions in the brackets 17 as indicated at 17*a*. The brackets 17 are rigidly secured to machine frame members 1''. Thus, the counter rollers 13*a* may be adjusted in their positions corresponding to the extension of the respective section of the cross arm 7*a*. Spring type spreader arms 9 make sure the fabric coming through between the rollers 12*a* and 13*a* is properly flattened out again. The elastic end of the spreader arm 9 is also adjustable in its position as may be seen by comparing the left-hand spreader member 9 with the right-hand spreader 9 in FIG. 6. Thus, a smooth transition of the spread-out tubular fabric into the flattened again fabric is assured.

As shown in FIG. 7, the singed and flattened again fabric also passes between the roller pairs 5*a* and 6*a* onto a withdrawal or pulling roller 15 leading the fabric to further rollers 15*a* and 15*b*. A motor 8 drives the various withdrawal rollers, for example, through a chain or belt drive 8*a* that may be tightened by adjustable tightening means 8*b*. The positive drive of the roller 5*a* on the left-hand side of FIG. 7 is derived from the drive member 8*a*. The positive drive of the right-hand roller 5*a* in FIG. 7 is derived from the roller 15 with the aid of a pulley or chain 14. Incidentally, the spring 18 could, for example, be a helical or spiral spring in a housing 18*b* shown in FIG. 7.

The rollers 13*a*, 15*a*, 15, 15*a*, and 15*b* are mounted to mounting plates 1*d* interconnected by two horizontal frame members 1''. The mounting plates 1*d* are in turn journalled to the machine frame 1 at respective journals 1*e* so that the entire mounting structure including the mounting plates 1*d* and the frame members 1'' is tiltable relative to the machine frame 1 as indicated by the arrow 1*f*. Such tilting may be accomplished by a piston cylinder device 1*g*, one end of which is adjustably and titably secured to the machine frame 1 while its other end is pivoted to the mounting structure, including a shelf 1*h* for the drive motor 8. The tilting of the mounting structure about the journals 1e permits an adjustment of the position of the above described fabric guiding means including the rollers.

Figure 8:
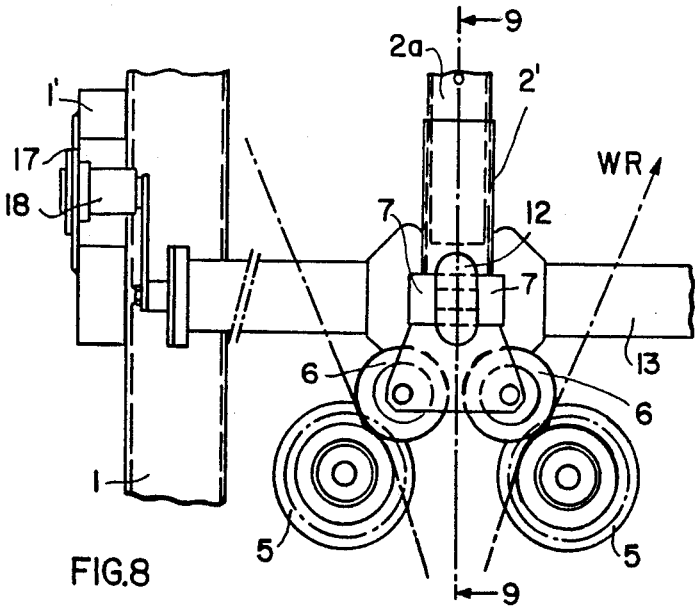
FIG. 8 illustrates that lead-in or lower end of the circular fabric spreader.
Figure 9:
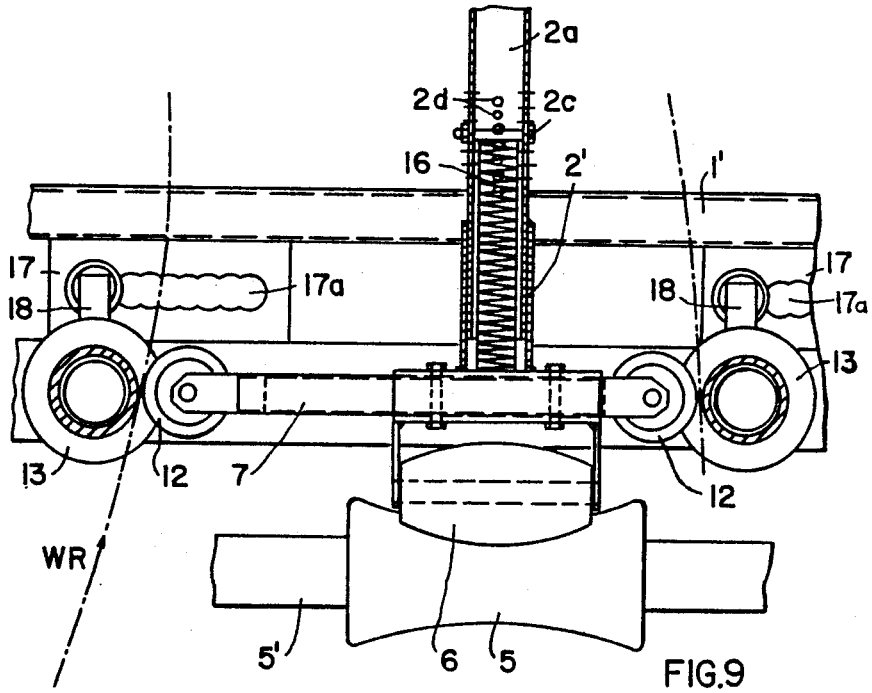
FIG. 9 is a sectional view along section plane IX—IX in FIG. 8.

Referring to FIGS. 8 and 9, the lower end of the fabric guide path and the circular spreader will now be described. The rollers 13 are mounted by components identical to the mounting components of the rollers 13*a*. Thus, the same reference numbers are employed for the mounting components of the rollers 13. The fabric is guided between the roller pairs 5 and 6. The rollers 6 are mounted to adjustable cross arms 7 and the rollers 5 are mounted to a drive shaft secured to the machine frame 1. The inner guide rollers 12 are secured to the ends of the cross arms 7 which are adjustable as described above for the cross arms 7*a*. The rollers 12 cooperate with the rollers 13 as described. The rollers 5 and 6 also have contoured surfaces as described. The adjustment of the position of the rollers 13 with the aid of the several mounting positions 17*a* in the brackets 17 again permits coordinating the position of the rollers 13 to the adjusted position of the rollers 12, please compare the left-hand side of FIG. 9 with the right-hand side of FIG. 9. Additionally, the rollers 13 can yield elastically as described above for the rollers 13*a* due to the springs 18.

The lower end of the central carrier 2*a* is received in a telescope type sleeve 2' and bears against the bottom of the sleeve 2' through a helical spring 16, the stiffness of which may be adjusted by a bolt 2*c* that may be passed through any one of a number of holes 2*d* in the central carrier 2*a*. The spring 16 makes sure that the spreader 2 with its carrier 2*a* is properly held between the lower and upper carrier and support rollers.

The carrier and support rollers at the lower end of the fabric path may also be positively driven by conventional means. Further, by controlling the motor 8, it is possible to apply to the fabric at its upper end a withdrawal speed which is somewhat higher than the inlet speed of the fabric into the singeing apparatus. In this manner a relative speed is applied to the fabric which in turn results in a longitudinal controllable stress for opening the individual meshes during the singeing. The control of this longitudinal stress will be adjusted in accordance with the requirements of the particular fabric by adjusting the respective speeds. However, in many instances it is satisfactory to positively drive only the carrier and support rollers at the outlet or upper end of the fabric path. In any case, the withdrawal pull combined with the radial stretching by the circular spreader will result in a widening of the meshes so that a uniform singeing throughout the circumference of the spreader is assured.

Although the invention has been described with reference to specific example embodiments, it will be appreciated that it is intended to cover all modifications and equivalents within the scope of the appended claims.

What I claim is:

1. An apparatus for singeing tubular textile fabric, comprising a machine frame having a central longitudinal axis, a guide path including a circular spreader for said fabric in said machine frame, singeing means including singeing nozzles mounted in said machine frame to surround said circular spreader for singeing said tubular textile fabric as it is spread by said spreader, said circular spreader comprising a number of fabric guide rings spaced from each other along said longitudinal axis for forming at least first and second spreader zones (I, II), said fabric guide rings including first and second neighboring fabric guide rings hving different diameters for forming said first spreader zone as a conical zone (I) of said circular spreader, adjustable mounting means for mounting said singeing nozzles in said first conical spreader zone for a three-dimensional position adjustment of said singeing nozzles relative to said first conical spreader zone, a third fabric guide ring for forming said second spreader zone, and cooling means arranged downstream of said first conical spreader zone as viewed in a travel direction of said tubular textile fabric, for cooling said tubular textile fabric after it has been singed.

2. The apparatus of claim 1, wherein said cooling means comprise at least one cooling ring surrounding said tubular textile fabric on said circular spreader downstream of said conical spreader zone.

3. The apparatus of claim 1, wherein said singeing nozzles are arranged in rings surrounding said conical first zone of said circular spreader.

4. The apparatus of claim 1, wherein said two neighboring fabric guide rings have a first ring with a smaller diameter and a second ring with a larger diameter, said first ring being located upstream of said second ring so that said conical first zone of said circular spreader tapers in a direction opposite to said travel direction of said tubular textile fabric toward a lead-in end of said circular spreader.

5. The apparatus of claim 1, wherein said cooling means comprise fan means for generating a cooling air flow.

6. The apparatus of claim 5, wherein said fan means comprise blower fan means for blowing cool air onto said singed tubular textile fabric.

7. The apparatus of claim 5, wherein said fan means comprise suction fan means for removing hot singeing gases, thereby generating a cooling air flow.

8. The apparatus of claim 7, wherein said cooling means comprise a ring type cooling system (K) located in said second spreader zone for cooling said tubular textile fabric, said ring type cooling system having an inner diameter smaller than an otuer diameter of said second fabric guide ring for contacting said tubular textile fabric, said ring type cooling system being suitable for flowing a coolant through said cooling system.

9. The apparatus of claim 1, wherein said two neighboring guide rings of said spreader comprise a first ring having a given diameter and a second ring having a diameter smaller than said given diameter of said first ring, said first ring being located upstream, as viewed in said travel direction of said tubular textile fabric of said second ring, so that at least said conical first spreader zone (I) tapers in said travel direction, said fabric guide rings further comprising a third ring with a diameter sufficient for forming siad second spreader zone so that said second spreader zone also has a conical shape which widens in said travel direction at least partly.

10. The apparatus of claim 1, further comprising a fourth fabric guide ring located downstream of said third fabric guide ring for forming a third spreader zone, said cooling means comprising cooling devices located for causing a cooling air flow in said third spreader zone.

11. The apparatus of claim 1, wherein said adjustable mounting means for said singeing nozzles comprise a position adjustable carrier frame to which said nozzles are attached, first threaded means securing said carrier frame to said machine frame for adjusting a position of said singeing nozzles in a direction in parallel to said central longitudinal axis through said machine frame, and second threaded means including bracket means connecting said singeing nozzles to said carrier frame for adjusting said nozzle position also in a direction radially to said central longitudinal axis for centering said singeing nozzles relative to said circular spreader.

12. The apparatus of claim 1, wherein said central longitudinal axis extends vertically, said singeing means comprising a plurality of nozzle rings carrying said singeing nozzles, said nozzle rings being arranged in a stack one above the other, said singeing nozzles being so directed that respective nozzle flames are focussed on a flame plane common for all nozzle rings.

13. The apparatus of claim 1, wherein said circular spreader further comprises a central ring carrier for said number of fabric guide rings which are secured to said central ring carrier at predetermined spacings from each other, said central ring carrier extending along said central longitudinal axis and having telescoping sections for adjusting an axial length of said central ring carrier against biasing spring means, said circular spreader further comprising two pairs of fabric support rollers (6) secured to axial ends of said central ring carrier, said fabric support rollers each having a contoured profile for contacting an inner surface of said tubular textile fabric, said apparatus further comprising two pairs of fabric guide rollers (5) each having a contoured surface for contacting an outer surface of said tubular textile fabric in cooperation with the respective contoured profile of said fabric support rollers for supporting and guiding said tubular textile fabric as it enters onto and departs from said circular spreader, and means for mounting said fabric guide rollers to said machine frame in positions permitting said cooperation with said fabric support rollers.

14. The apparatus of claim 13, wherein said fabric guide rollers have rotational axes extending in parallel to each other, and wherein said fabric support rollers also have rotational axes extending in parallel to each other and in parallel to said first mentioned rotational axes.

15. The apparatus of claim 13, further comprising cross-bar means (7) mounted to said central ring carrier in a transition zone between said first fabric guide ring and said fabric support rollers (6), further fabric guide rollers (12) secured to free ends of said cross-bar means for guiding said fabric on the inside thereof, counter rollers (13) spring mounted to said machine frame in positions for cooperation with said further fabric guide rollers (12) for positively guiding said tubular textile fabric.

16. The apparatus of claim 15, wherein said cross-bar means (7) comprise two sections which are longitudinally movable relative to each other for adjusting the length of said cross-bar means, and means for securing said cross-bar sections to each other in an adjusted position.

17. The apparatus of claim 1, further comprising auxiliary guide rings in the form of half rings having a radius larger than said first mentioned fabric guide rings, and means for securing said auxiliary guide rings radially outwardly to said first mentioned fabric guide rings for increasing an effective guide ring diameter.

18. The apparatus of claim 1, further comprising drive roller means for said tubular textile fabric and means for adjusting the speed of said drive roller means for controlling the travelling speed of said tubular textile fabric past said singeing nozzles.

19. The apparatus of claim 1, wherein said guide path for said tubular textile fabric comprises fabric tensioning means arranged for applying a longitudinally effective tension to said tubular textile fabric where said tubular textile fabric moves past said singeing nozzles.

20. The apparatus of claim 1, wherein said cooling means comprise a ring type cooling system (K) located in said second spreader zone for cooling said tubular textile fabric, said ring type cooling system having an inner diameter smaller than an outer diameter of said second fabric guide ring for contacting said tubular textile fabric, said ring type cooling system being suitable for flowing a coolant through said cooling system.

21. The apparatus of claim 1, wherein said cooling means comprise a first cooling device (A) for blowing cool air onto and through said tubular textile fabric and a second cooling device (B, C) located downstream of said first cooling device, for sucking hot air out of said tubular textile fabric

* * * * *